US006024110A

United States Patent [19]

Renfro

[11] Patent Number: 6,024,110

[45] Date of Patent: Feb. 15, 2000

[54] GOLF CLUB CANE

[76] Inventor: William L. Renfro, 1431 33rd St., NW., Washington, D.C. 20007

[21] Appl. No.: 09/086,670

[22] Filed: May 29, 1998

[51] Int. Cl.[7] ..... A45B 9/02

[52] U.S. Cl. ..... 135/66; 135/86; D3/7; D3/14

[58] Field of Search ..... 135/66, 76, 77, 135/82, 86; 473/299, 307, 330; D3/7, 12, 14, 16; D21/733, 735, 747, 748, 750, 756

[56] References Cited

U.S. PATENT DOCUMENTS

| | | | |
|---|---|---|---|
| D. 317,491 | 6/1991 | Rhodes . | |
| D. 319,276 | 8/1991 | Keeler . | |
| D. 319,277 | 8/1991 | Antonious . | |
| 626,347 | 6/1899 | Smith | 473/330 |
| 1,525,137 | 2/1925 | Lawton | 473/330 |
| 1,673,994 | 6/1928 | Quynn | 473/330 |
| 2,468,202 | 4/1949 | Karns | D21/756 |
| 2,642,884 | 6/1953 | Henderson et al. | 135/86 |
| 2,926,913 | 3/1960 | Stecher | D21/759 |
| 3,027,163 | 3/1962 | Saayzer | D21/747 |
| 4,917,384 | 4/1990 | Caiati | 473/330 |
| 5,333,862 | 8/1994 | Teramoto et al. | 473/330 |
| 5,361,793 | 11/1994 | Stahnke . | |
| 5,566,700 | 10/1996 | Brown . | |
| 5,573,025 | 11/1996 | Atlas . | |
| 5,699,819 | 12/1997 | Simons | 135/77 |

*Primary Examiner*—Michael Safavi
*Attorney, Agent, or Firm*—Fisher, Christen & Sabol

[57] ABSTRACT

A cane which includes a golf club head which acts as a handle, a shaft, and a rubber or other non-slip material tip. The golf club cane can also include, for example, an indentation in the golf club head, and a rubber or other non-slip surface on the base of the head.

2 Claims, 2 Drawing Sheets

FIG. 1
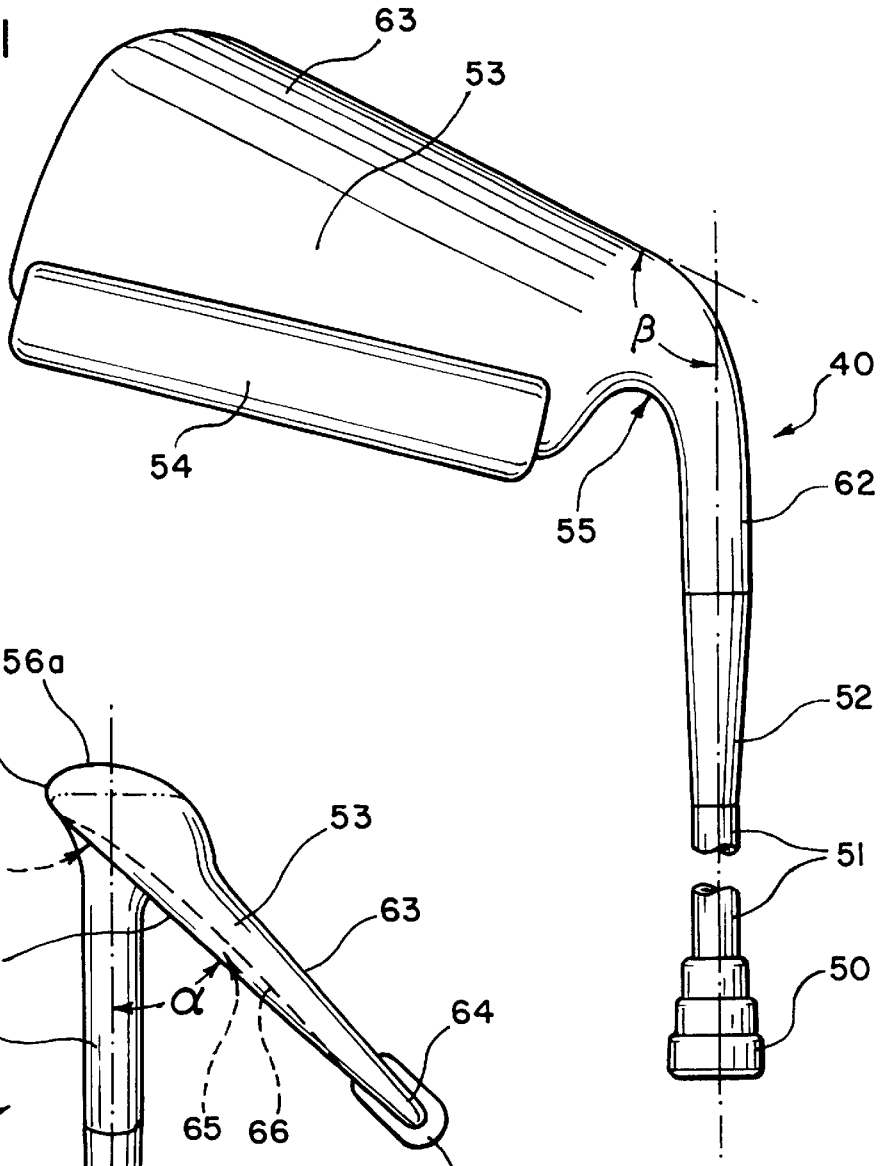
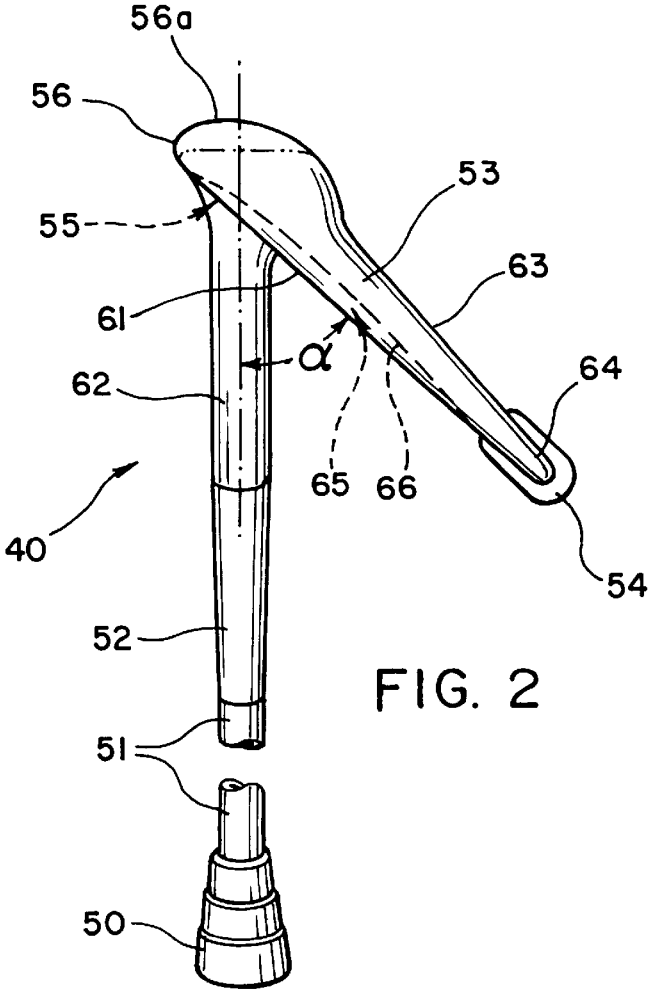
FIG. 2

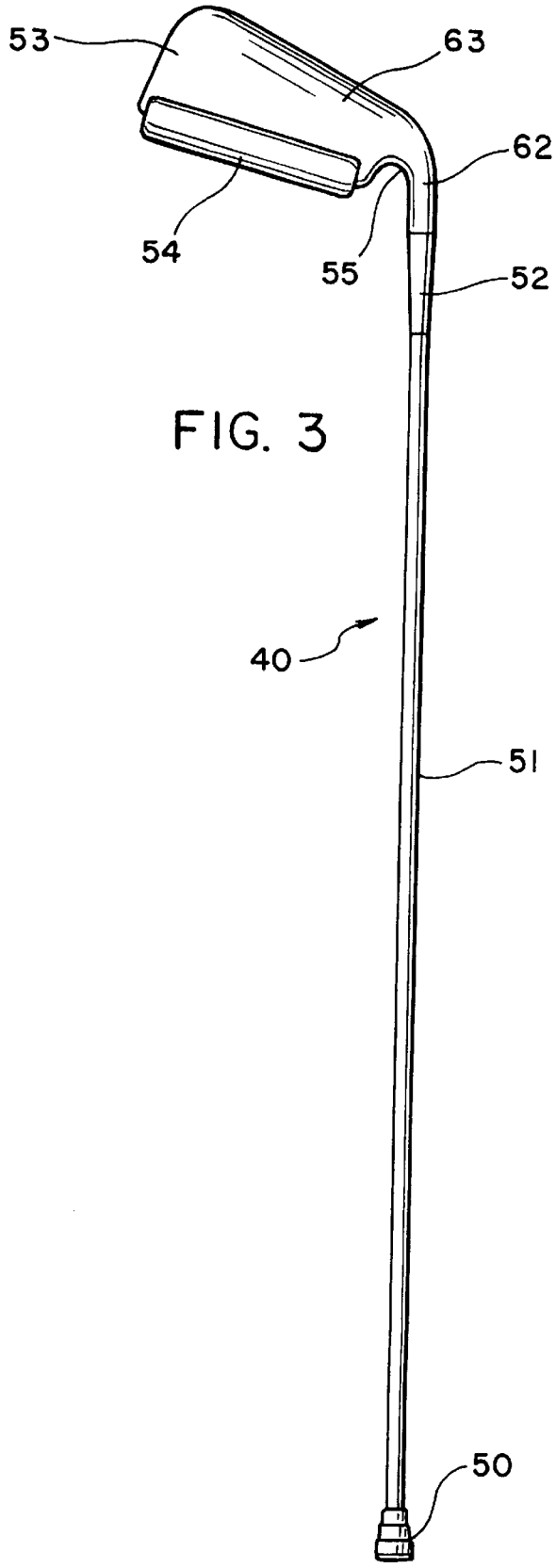
FIG. 3
FIG. 4
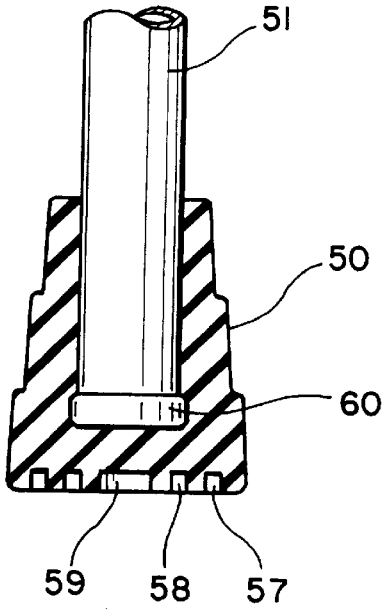
FIG. 5
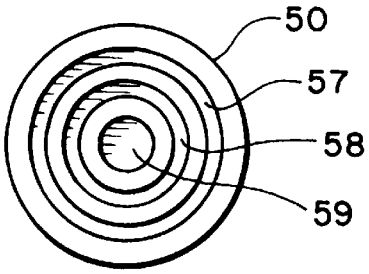

GOLF CLUB CANE

BACKGROUND OF THE INVENTION

1. Field Of The Invention

The invention relates to a cane and, in particular, to a cane which appears to be an upside down golf club and which includes a handle in the general shape of a golf club head.

2. Description Of Related Art

Prior art golf club canes include those disclosed and claimed in U.S. Design Pat. No. 317,491 (Rhodes) and U.S. Design Pat. No. 319,276 (Keeler). U.S. Design Pat. No. 317,491 (Rhodes) is a combination golf club and walking stick. Rhodes includes a golf club head at the bottom of the walking stick and a hook-shaped handle. Similarly, U.S. Design Pat. No. 317,491 is a walking stick putter which includes a golf club head at the bottom of the walking stick and a knob-shaped handle.

BROAD DESCRIPTION OF THE INVENTION

An object of the invention is to overcome the disadvantages and problems of prior art canes. For example, an object of the invention is to have a cane which looks like a golf club as opposed to a walking stick, and which has a comfortable handle which fits well the shape of a gripping hand. The shape and angle of certain golf club heads are suitable for use as a hand grip, and which with modification are more suitable. The invention cane is comfortable and fits a gripping hand well, with the thumb over the trailing edge and the fingers gripping over the leading edge. Weight is well distributed over such a broad handle and, thus, hand strain is avoided. In addition, the shape of the golf club head can be modified to fit the particular contours of a gripping human hand.

Other objects and advantages of the invention are set out herein or are obvious herefrom to one skilled in the art.

The objects and advantages of the invention are achieved by the golf club cane of the invention.

The invention includes a golf club head which acts as a handle which a person grips, a shaft with the golf club head at its top end, and a rubber or other non-slip material tip at the bottom of the shaft. The golf club cane can also include, for example, an indentation or notch in the golf club head, where it joins the shaft, and/or a rubber or other non-slip surface on the outer edge base of the head. On the surface corresponding to that used to hit a golf ball, is a depression or cup with an abrasive or non-skid surface.

The invention may be used by either right handed or left handed persons. The cane shown in FIGS. 1 to 3 is to be used by right handed players. The cane which is to be used by left handed players is a mirror image of the cane to be used by right handed players. In all other respects, the right-handed cane and the left handed cane are identical to one another.

The shaft can be of different lengths so, that the golf club cane of the invention can be used by users of different heights and differing needs. The shaft can be solid or hollow, like a golf club shaft. The shaft can be tapered or not and can be made of any suitable material which will provide sufficient strength to allow use of the invention device as a cane. Preferably, the shaft is hollow and made of stainless steel or another steel alloy. Examples of other materials which can be used for the shaft are wood, fiberglass, rigid plastic, carbon fiber or synthetic fibers or materials and other metals, such as, aluminum, titanium alloy and iron.

Modifications and changes made to the golf club cane can be effected without departing from the scope or spirit of the present invention. For example, the tip can be made of a non-slip metal or plastic, as opposed to being made of rubber. Also, the embodiments of this golf club cane, which are illustrated as follows, have been shown only by way of example and should not be taken to limit the scope of the following claims.

BRIEF DESCRIPTION OF THE DRAWINGS

In the drawings:

FIG. 1 is a broken back view of the golf club head (including the indentation in it and the firm rubber or other non-slip surface on it), the shaft extending from the head, and the rubber or other non-slip tip affixed to the other end of the shaft.

FIG. 2 is a broken left view of the golf club head (including the cup in it and the firm rubber or other non-slip surface on it), the shaft (at a slight angle) extending from the head, and the rubber or other non-slip tip;

FIG. 3 is a back view of the golf club head (including the indentation in it and the firm rubber or other non-slip surface on it), the shaft extending from the head, and the rubber or other non-slip tip;

FIG. 4 is a front view of the bottom portion of the cane with a vertical cross-sectional view of the rubber tip; and FIG. 5 is a bottom view of the rubber tip.

DETAILED DESCRIPTION OF THE INVENTION

As shown in FIG. 1, the invention cane (40) includes a main shaft (51). The shaft (51) has a lower portion with a lower end and an upper portion with an upper end. The length of the shaft (51) can be varied according to the height and needs of the person who will be using the cane (40). The shaft (51) can be made out of any material strong enough to withstand the weight of a person directly placed upon it. For example, the shaft (51) could be made out of metal, wood, fiberglass, plastic or carbon fiber or synthetic fibers or materials, firm rubber, and, preferably, it is composed of tubular or tapered stainless steel.

Attached to the lower end of the lower portion of the shaft (51) is a tip (50). The tip (50) can be attached only to the lower end of the lower portion of the shaft (51), or it can include a portion which extends up and around part of the lower portion of the shaft (51). For example, the tip (50) can be a furniture leg, hard-rubber bottom with the end of the shaft (51) fitting therein. Preferably, the portion of the tip (50) which will contact the ground surface is broader than is the portion which extends up and around part of the lower portion of the main shaft (51). The tip (50) can be made out of a hard rubber or any other non-slip material. The tip (50) prevents the bottom of the cane (40) from slipping or sliding when it is placed on the ground or other surface and the weight of a person is applied on it.

FIG. 4 shows the tip (50) on the bottom end of the shaft (51) which has the rim (60). The rim (60) holds the tip (50) more firmly in place on the end of the shaft (51). FIG. 5 shows the bottom of the tip (50) which has the center depression (59) and concentric grooves (57 and 58) to assist in making the tip (50) more slide or slip resistant during use.

The tip (50) of the golf club cane (40) can be used to crush an empty can (such as an aluminum soda can) with the crushed can gripping the tip (50) and, then, the tip (50) of the cane (40) can be used to pick up the can and place it in a trash or recycling receptacle. An advantage of this is that the person using the cane (40) does not have to lean down in order to pick up the crushed can off of the floor or other surface.

The golf club head (53) is attached to the shaft (51) in a fixed or detachable manner (e.g., threaded). In FIGS. 1 to 3, head (53) is composed of the elongated portion (62) and the head portion (63). The elongated portion (62) is attached to the shaft (51). The main head portion (63) is elongated and is at an angle to the shaft (51). The angle β (see FIG. 1) is formed by the longitudinal axis of the shaft (51) and the line of the outer or top edge (surface) of the main portion (63) of the head (53). The angle β can be perpendicular, slightly acute or obtuse, but, preferably, it is 105 to 140 degrees, and most preferably it is 110 to 125 degrees.

The golf club head (53) preferably has the general shape of the head of an eight iron or nine iron. The golf club head (53) can be made out of any appropriate material, such as, metal, plastic, wood, a hard rubber or fiberglass, stainless steel or another steel alloy. Perferably, it is made out of stainless steel. Referring to FIG. 2, preferably, the angle α between the plane of the face (61) of the golf club head (53) and the plane perpendicular to the longitudinal axis of the shaft (51) is between about 35 and 55 degrees, and, most preferably, it is about 45 to 50 degrees. Also, the golf club head can have the shape of the head of a one, two, three, four, five, six or seven iron, or a putter, or a sand wedge, or a one, two, three, four or five wood, for example.

The cup or depression (65) is on the surface (61) and the surface (66) of cup (65) can have an abrasive or non-skid surface. The cup or depression (65) can be used to assist in picking up and holding small objects, eliminating the need to reach or bend down. The presence of this cup or depression (65) does not interfere with the use of the club-like head as a handle.

The golf club head (53) serves as a handle or hand grip. The shape and angle of the head (53) is ideal for use as a hand grip. It is a comfortable hand grip, as the hand of a person fits well on it with the thumb over the trailing edge (56) and with the other fingers gripping over the leading edge (56). Because the head (53) is a broad handle, it distributes more weight without causing hand strain. In addition, the shape of the golf club head (53) can be modified or rounded **(56, 56*a*) from the relatively flat golf club surface (56*b*)** to fit the particular contours of a gripping human hand.

The short tubular section (52) fits onto the shaft (51) to provide a smooth contour from the elongated portion (62) to the shaft (51).

The instant invention can be used by either right handed or left handed persons. The golf club cane (40) shown in FIGS. 1 to 3 is to be used by right handed players. The cane (40) which is to be used by left handed players is a mirror image of the cane (40) to be used by right handed players. In all other respects, the right handed cane (40) and the left handed cane (40) are identical to one another.

The notch or indentation (55) is located on the leading edge (64) of golf-club-like head (53) where the edge meets the elongated head portion (62). The notch (55) is preferably of a semi-circular shape with a curvature of the cross section of the elongated head portion (62) where it joins the golf-club-like head (53). The center of the approximately semi-circular notch (55) is on a line from the apex of angle β minus 90 degrees from the longitudinal axis of the shaft (51).

The notch (55) in the head (53) of the golf club cane (40) allows the user of it to hang up the cane (40), perhaps over a nail or peg or similar protrusion, or over a hanger, or a rope or belt. Also, the notch (55) in the head (53) can be used to pull objects towards the user, when the user inverts the cane (40). The notch (55) can be any appropriate size and shape. Preferably, the notch (55) is located on the inside or lower side of the head (53) of the golf club (40), at the intersection between the elongated portion (62) and main head portion (63).

There can be a rubber or other non-slip surface or part (54) adhered to and running along all or part of the lower edge (64) (lower surface parallel with the ground) of the main head portion (63) of the golf club head (53). Preferably, this rubber or other non-slip part (54) is either U-shaped, with each side of the U extending up from an opposite side of the lower or leading edge (64) towards the main head portion (63) of the top of the head (53), or L-shaped or J-shaped. When the golf club cane (40) includes this rubber or other non-slip surface (54), the head (53) of the cane (40) can be hung upon, for example, the edge of a counter, surface or a table top, without moving, sliding or falling off. The rubber or other non-slip material the surface (54) is made of should be firm enough for this purpose. Also, the rubber or other nonslip surface (54) serves to protect the surface of whatever the golf club head (53) is placed upon from being scratched, scraped, nicked, etc., by the golf club cane (40).

If a person drops the golf club cane, he or she can pick it up without having to lean over. Instead, he or she can step on the golf club head (53) and roll the main shaft (51) and tip (50) upwards. Then, he or she can simply invert the cane, gripping the handle/head (53).

Also, the golf club head (53) can be used to pick up small objects. A person can invert the cane (40), wedge the object between the head of the cane (53) and the person's foot and, then, lift the object by slowly raising both the head (53) and if necessary the person's leg/foot at the same time.

A person can use the golf club head (53) to push around or move out of the way small objects within his or her reach. For example, one could hit a ball to or away from a dog or child. The golf club cane (40) can be used even as an emergency dog leash. Also, one can use the head (53) of the golf club (40) in an emergency, defensive situation, for example, if being approached quickly by a hostile dog.

When a person uses the golf club cane (40), he or she may appear to be an errant golfer with, perhaps a bad slice, or a fanatic golfer, as opposed to a person in need of walking assistance.

LIST OF PARTS NUMBERS

In connection with the figures, the following list of the names of the parts of the instant invention are noted:

| | |
|---|---|
| 50 | rubber or other non-slip material tip; |
| 51 | shaft; |
| 52 | plastic; |
| 53 | golf club head; |
| 54 | rubber or other non-slip surface or portion; |
| 55 | notch or indentation in the head; |
| 56 | trailing edge of the elongated head portion; |
| 57 | groove; |
| 58 | groove; |
| 59 | center depression; |
| 60 | rim at end of the shaft; |

-continued

| | |
|---|---|
| 61 | bottom flat portion of the head; |
| 62 | elongated head portion; and |
| 63 | main head portion; |
| 64 | leading edge of the elongated head portion. |
| 65 | cupped surface or depression surface |
| 66 | non-slip surface of 65 |

What is claimed is:

1. A golf club cane, which comprises:

(a) a shaft having a lower portion with a lower end and an upper portion with an upper end;

(b) a tip attached to the lower end of the lower portion of the shaft;

(c) a head in the general shape of a golf club head and, having a main portion and a secondary portion, the secondary portion being attached to the shaft and the main portion being located at an angle to the longitudinal axis of the shaft so as to form a hand grip or handle, and the main portion having a narrower region at its end which merges with the secondary portion;

(d) a notch or indentation in the golf club head between where the main portion of the head and the narrower portion of the head meet, the notch or indentation facing the tip; and (e) a U-shaped part of non-slip material affixed along at least a portion of the trailing vane portion of the golf club head.

2. The golf club cane as claimed in claim 1, wherein the angle between the plane which is perpendicular to the longitudinal axis of the shaft and the said surface of the main portion of the head is between about 35 and 55 degrees.

* * * * *